US009417586B2

(12) United States Patent
Izumichi

(10) Patent No.: US 9,417,586 B2
(45) Date of Patent: Aug. 16, 2016

(54) SHEET DISCHARGE DEVICE AND IMAGE FORMING APPARATUS INCLUDING THE SAME

(71) Applicant: KYOCERA Document Solutions Inc., Osaka-shi, Osaka (JP)

(72) Inventor: Sachio Izumichi, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/631,662

(22) Filed: Feb. 25, 2015

(65) Prior Publication Data

US 2015/0248098 A1 Sep. 3, 2015

(30) Foreign Application Priority Data

Feb. 28, 2014 (JP) ..... 2014-038079

(51) Int. Cl.
*B65H 31/02* (2006.01)
*G03G 15/00* (2006.01)
*B65H 43/06* (2006.01)

(52) U.S. Cl.
CPC ..... *G03G 15/6529* (2013.01); *B65H 31/02* (2013.01); *B65H 43/06* (2013.01); *B65H 2301/4212* (2013.01); *B65H 2402/63* (2013.01); *B65H 2403/51* (2013.01); *B65H 2511/16* (2013.01); *B65H 2511/416* (2013.01); *B65H 2511/51* (2013.01); *B65H 2511/515* (2013.01); *B65H 2553/414* (2013.01); *B65H 2553/612* (2013.01); *B65H 2553/81* (2013.01); *B65H 2801/06* (2013.01)

(58) Field of Classification Search
CPC ..... B65H 43/06; B65H 43/08
USPC ..... 271/176, 207, 220, 314
See application file for complete search history.

(56) References Cited

U.S. PATENT DOCUMENTS

| | | | | | |
|---|---|---|---|---|---|
| 2,579,541 | A * | 12/1951 | Bobst | B65H 43/06 | 271/215 |
| 3,968,364 | A * | 7/1976 | Miller | B65H 43/08 | 250/231.1 |
| 5,033,731 | A * | 7/1991 | Looney | B65H 43/08 | 271/176 |
| 5,609,333 | A * | 3/1997 | Mandel | B65H 39/11 | 270/58.09 |
| 5,823,529 | A * | 10/1998 | Mandel | B65H 39/11 | 271/176 |
| 5,963,754 | A * | 10/1999 | Itoh | B65H 29/14 | 271/258.01 |
| 6,113,094 | A * | 9/2000 | Horiguchi | B65H 31/02 | 271/176 |
| 2005/0035535 | A1* | 2/2005 | Ogata | B65H 43/02 | 271/220 |
| 2014/0062002 | A1* | 3/2014 | Murashima | G03G 15/6552 | 271/207 |
| 2015/0054215 | A1* | 2/2015 | Sato | B65H 43/06 | 271/208 |
| 2015/0102548 | A1* | 4/2015 | Balili | B65H 31/10 | 270/58.09 |

FOREIGN PATENT DOCUMENTS

| | | |
|---|---|---|
| JP | 09020036 A | 1/1997 |
| JP | 10120295 A | 5/1998 |

* cited by examiner

*Primary Examiner* — David H Bollinger
(74) *Attorney, Agent, or Firm* — Alleman Hall McCoy Russell & Tuttle LLP

(57) ABSTRACT

A sheet discharge device includes a discharge roller, a detection portion, and a detection position changing mechanism. The discharge roller is configured to discharge a sheet from a sheet discharge port toward a sheet discharge tray. The detection portion is configured to detect that a stack height of sheets on the sheet discharge tray has reached a predetermined detection position. The detection position changing mechanism is configured to change the detection position for the detection portion.

3 Claims, 12 Drawing Sheets

SHEET DISCHARGE DEVICE AND IMAGE FORMING APPARATUS INCLUDING THE SAME

INCORPORATION BY REFERENCE

This application is based upon and claims the benefit of priority from the corresponding Japanese Patent Application No. 2014-038079 filed on Feb. 28, 2014, the entire contents of which are incorporated herein by reference.

BACKGROUND

The present disclosure relates to a sheet discharge device for discharging a sheet from a sheet discharge port onto a sheet discharge tray, and to an image forming apparatus including the sheet discharge device.

A conventional image forming apparatus includes a full-stack detection mechanism that detects whether or not the amount of sheets stacked on a sheet discharge tray is equal to or larger than a predetermined amount, in order to prevent a sheet discharge port from being closed by the discharged sheets. The full-stack detection mechanism detects whether or not the amount of a stack of sheets on the sheet discharge tray has reached the predetermined amount, by determining whether or not the height of the stack of sheets on the sheet discharge tray has reached a predetermined full-stack detection height.

SUMMARY

A sheet discharge device according to an aspect of the present disclosure includes a discharge roller, a detection portion, and a detection position changing mechanism. The discharge roller is configured to discharge a sheet from a sheet discharge port toward a sheet discharge tray. The detection portion is configured to detect that a stack height of sheets on the sheet discharge tray has reached a predetermined detection position. The detection position changing mechanism is configured to change the detection position for the detection portion.

An image forming apparatus according to another aspect of the present disclosure includes the sheet discharge device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

[First Embodiment]

Figure 1:
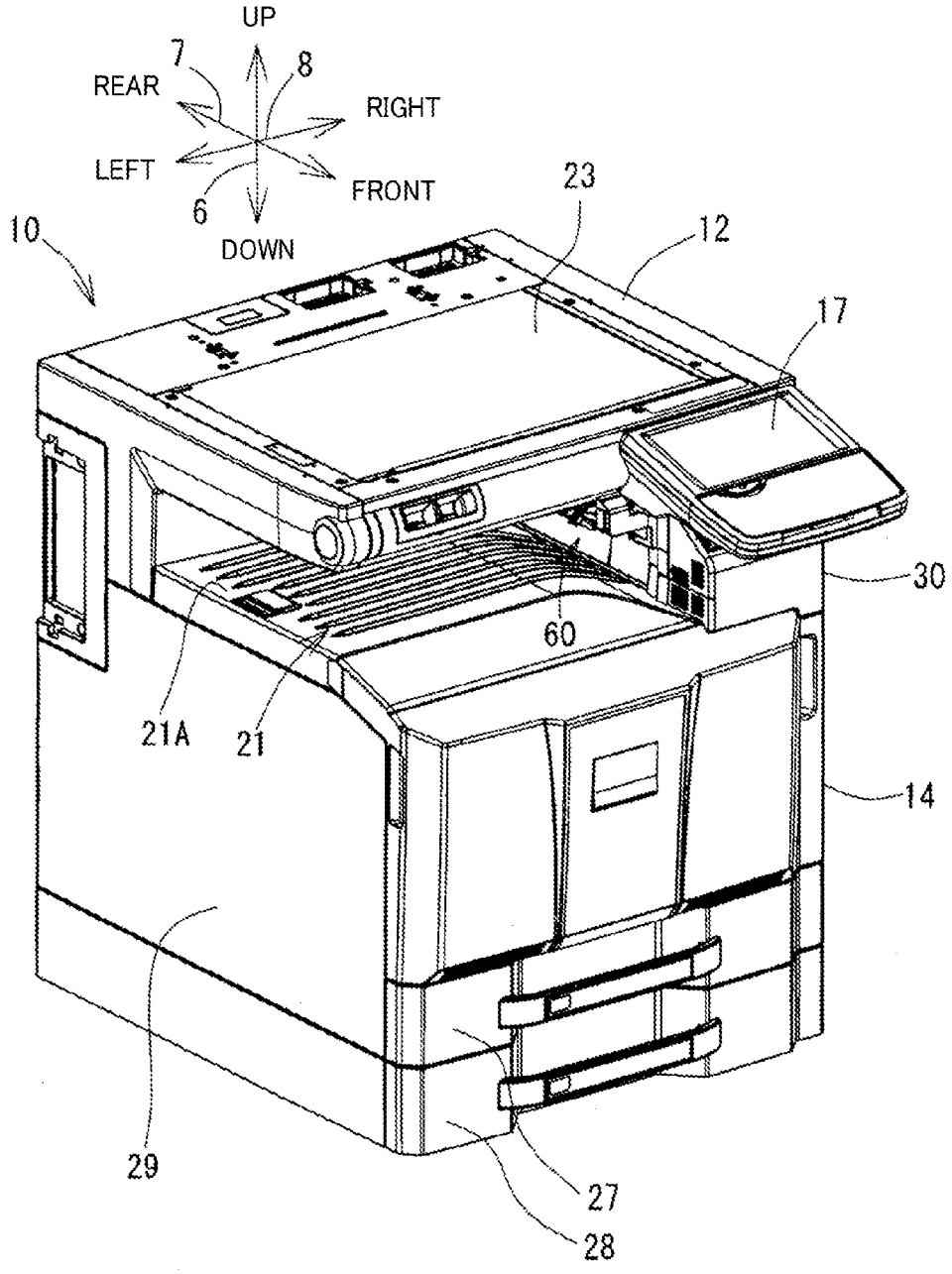
FIG. 1 is a perspective view showing an image forming apparatus in the first embodiment of the present disclosure.

The following describes, with reference to the drawings, a sheet discharge device 60 according to the first embodiment of the present disclosure and an image forming apparatus 10 including the sheet discharge device 60. It is noted that for the sake of explanation, an up-down direction 6 is defined as the vertical direction in the state (the state shown in FIG. 1) where the image forming apparatus 10 is installed on a flat surface. In addition, a front-rear direction 7 is defined on the supposition that a surface on which an operation display panel 17 is provided is the front surface (front side). Furthermore, a left-right direction 8 is defined based on the front surface of the image forming apparatus 10. It is noted that embodiments described in the following are merely concrete examples of the present disclosure, and are not intended to limit the technical scope of the present disclosure.

First, the configuration of the image forming apparatus 10 will be described with reference to FIGS. 1 and 2. As shown in FIG. 1, the image forming apparatus 10 is a so-called "in-body discharge type" multifunction peripheral, and has various functions such as a printer, a copier, a facsimile, a scanner, and the like. The image forming apparatus 10 forms an image of an input image onto a print sheet P (an example of the sheet of the present disclosure) by using a print material such as toner. Note that the image forming apparatus 10 is not limited to a multifunction peripheral, and the present disclosure is also applicable to a specialized device such as a printer, a copier, a facsimile, a scanner provided with an ADF 13, or the like.

The image forming apparatus 10 includes an image reading portion 12 and an image forming portion 14. The image reading portion 12 performs the process of reading an image from a document sheet, and is provided in the upper part of the image forming apparatus 10. The image forming portion 14 performs the process of forming an image based on the electrophotography, and is provided below the image reading portion 12. The image forming portion 14 includes two sheet feed devices 27 and 28 that are arranged as two tiers in the vertical direction. The sheet feed device 27, the upper one of the two sheet feed devices, is integrally formed with a housing 29 at the lowest part of the image forming portion 14. The sheet feed device 28, the lower one of the two sheet feed devices, is extension-type and is attached to the bottom surface of the housing 29 of the image forming portion 14 as an option device. The sheet feed device 28 is configured to be attachable/dechable to/from the bottom surface of the housing 29. In addition, a paper sheet discharge portion 30 is provided in the right side of the image forming portion 14. It is noted that the image forming method of the image forming portion 14 is not limited to the electrophotography, but may be an inkjet recording method or other recording or printing methods.

Above the image forming portion 14, there is provided a sheet discharge space 21 to which print sheets P are discharged. The paper sheet discharge portion 30 is formed in such a way as to couple the image forming portion 14 with the image reading portion 12 with the sheet discharge space 21 provided therebetween. As shown in FIG. 1, the front side and the left side of the sheet discharge space 21 are opened, while the rear side and the right side thereof are not opened. Specifically, the rear side is closed, and in the right side, the paper sheet discharge portion 30 is provided. In the sheet discharge space 21, a sheet discharge tray 21A (an example of the sheet discharge tray of the present disclosure) for holding discharged print sheets P in a stacked manner is provided. In the present embodiment, the sheet discharge device 60 is provided in the paper sheet discharge portion 30.

The sheet discharge tray 21A is configured to hold a plurality of discharged print sheets P thereon in a stacked manner, and is provided on the upper surface of the image forming portion 14. The sheet discharge tray 21A is formed from ABS resin by the injection molding. A paper sheet holding surface, namely the upper surface of the sheet discharge tray 21A has a plurality of ribs 44 (see FIG. 3). The ribs 44 extend in the same direction as the discharge direction of the print sheet P (the left-right direction 8). It is noted that the material of the sheet discharge tray 21A is not limited to the ABS resin, but may be a synthetic resin other than the ABS resin.

As shown in FIG. 1, the image reading portion 12 includes a document sheet placing table 23. When the image forming apparatus 10 functions as a copier, a document sheet is set on the document sheet placing table 23, and after a document sheet cover 24 (see FIG. 2) is closed, a copy start instruction is input from an operation display panel 17. This causes the image reading portion 12 to start the reading operation to read image data from the document sheet. The read image data is sent to the image forming portion 14. It is noted that in FIG. 1, the document sheet cover 24 (see FIG. 2) of the image reading portion 12 is omitted.

Figure 2:
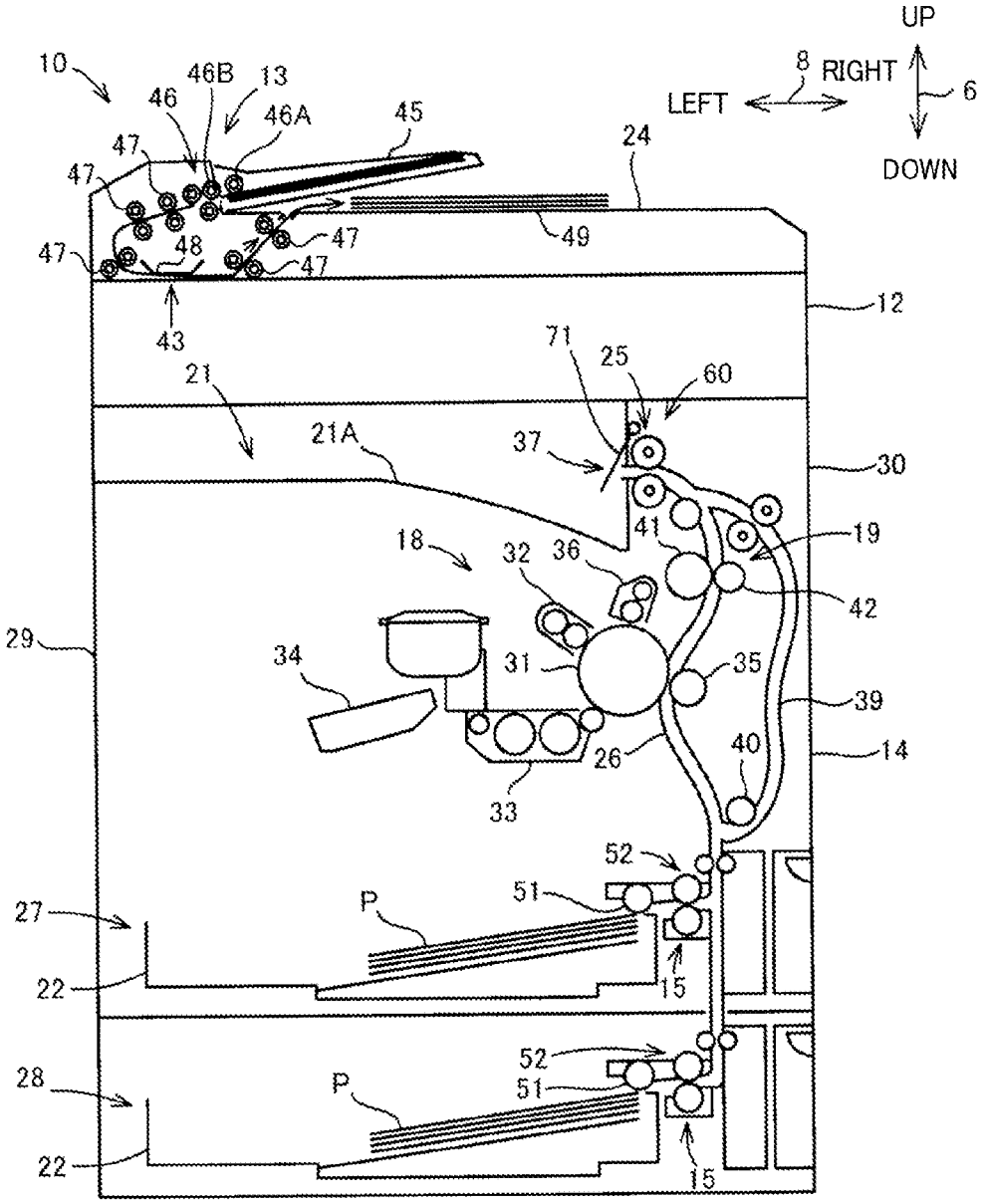
FIG. 2 is a schematic diagram showing the internal configuration of the image forming apparatus of FIG. 1.

In addition, as shown in FIG. 2, the image reading portion 12 includes an ADF 13. The ADF 13 is provided in the document sheet cover 24. The ADF 13 is an automatic document sheet feeding device and includes a document sheet tray 45, a feeding mechanism 46, a plurality of conveying rollers 47, a paper sheet pressing 48, a sheet discharge portion 49, and the like. The ADF 13 drives the feeding mechanism 46 and the conveying rollers 47 by motors (not shown) respectively to feed a document sheet set on the document sheet tray 45 such that the document sheet is conveyed to the sheet discharge portion 49 after passing a reading position 43 on the document sheet placing table 23. The feeding mechanism 46 includes a pick-up roller 46A for picking up a document sheet and a feeding roller 46B for feeding the document sheet picked up by the pick-up roller 46A. A document sheet is picked up by the pick-up roller 46A from the document sheet tray 45 and fed by the feeding roller 46B toward the downstream side in the feeding direction. The document sheet is further conveyed by a conveying roller 47 that is provided in the downstream side in the feeding direction. The image reading portion 12 reads the image from the document sheet at the reading position 43 when the document sheet conveyed by the ADF 13 passes the reading position 43.

The image forming portion 14 forms an image on a print sheet P based on the image data which has been read by the image reading portion 12 or input from the outside, wherein the print sheet P has a specific size such as an A series size or a B series size. The image forming portion 14 performs a single side print process (single side image forming process) or a double side print process (double side image forming process) based on a print mode (a single side print mode or a double side print mode) which is set in advance. In the single side print process, an image is formed on a side of a print sheet P; and in the double side print process, images are formed on both of opposite sides of a print sheet P. During the single side print process, the image forming portion 14 discharges the print sheet P with an image formed on one side thereof onto the sheet discharge tray 21A of the sheet discharge space 21. On the other hand, during the double side print process, the image forming portion 14 switches back a print sheet P with an image formed on one side thereof, sends it into a reverse conveyance path 39, forms an image on the reverse side of the print sheet P as well, and then discharges the print sheet P with images formed on both sides into the sheet discharge tray 21A of the sheet discharge space 21.

As shown in FIG. 2, the image forming portion 14 mainly includes the sheet feed devices 27, 28, an electrophotographic image transfer portion 18, a fixing portion 19, the sheet discharge device 60, a control portion (not shown) for comprehensively controlling the image forming portion 14, and the like. That is, the image forming apparatus 10 includes the sheet discharge device 60. In addition, the image forming portion 14 includes a conveyance motor and a discharge motor (both not shown). These portions are provided inside the housing 29 that constitutes the outer frame cover, the internal frame and the like of the image forming portion 14.

The sheet feed devices 27, 28 convey a print sheet P toward the image transfer portion 18. Each of the sheet feed devices 27 and 28 includes: a paper sheet storing portion 22 in the shape of a tray; and a feeding mechanism 15. In the paper sheet storing portion 22, print sheets P (print sheets P used for image formation) on which images are to be formed by the image transfer portion 18 are stored in a stacked manner. The feeding mechanism 15 picks up and conveys, one by one, the print sheets P stored in the paper sheet storing portion 22. The feeding mechanism 15 is provided above the right end of the paper sheet storing portion 22. The feeding mechanism 15 includes a pick-up roller 51 and a pair of feeding rollers 52. When an instruction to feed a print sheet P is input to the image forming apparatus 10, the conveyance motor is rotationally driven. This allows the pick-up roller 51 and the pair of feeding rollers 52 to rotate. The pick-up roller 51 then picks up a print sheet P from the sheet storing portion 22, and the print sheet P is fed by the pair of feeding rollers 52 toward the downstream side in the feeding direction.

As shown in FIG. 2, in the image forming portion 14, a conveyance path 26 is formed to extend upward from the pair of feeding rollers 52 of the sheet feed device 28. The conveyance path 26 is formed in the right-side part of the housing 29. The conveyance path 26 extends in the up-down direction 6 along the right side surface, and reaches a paper sheet discharge port 37 (an example of the sheet discharge port of the present disclosure) via the fixing portion 19.

The image transfer portion 18 is provided above the sheet feed device 27. The image transfer portion 18 performs an image transfer process onto the print sheet P conveyed from the sheet feed devices 27, 28. Specifically, the image transfer portion 18 transfers a toner image onto a print sheet P based on the input image data, using a print material such as toner. As shown in FIG. 2, the image transfer portion 18 includes a photoconductor drum 31, a charging portion 32, a developing portion 33, an LSU (Laser Scanning Unit) 34, a transfer roller 35, and a cleaning portion 36.

The photoconductor drum 31 is provided in the left side of the conveyance path 26. When the image forming operation is started, the charging portion 32 charges the surface of the photoconductor drum 31 uniformly into a certain potential. In addition, the LSU 34 scans the photoconductor drum 31 with laser light based on the image data. This allows an electrostatic latent image to be formed on the photoconductor drum 31. Subsequently, the developing portion 33 causes the toner to adhere to the electrostatic latent image, and a toner image is formed on the photoconductor drum 31. The transfer roller 35 is provided in the right side of the conveyance path 26, and is disposed to face the photoconductor drum 31 across the conveyance path 26. When the print sheet P conveyed in the conveyance path 26 passes through a nip portion between the transfer roller 35 and the photoconductor drum 31, the toner image is transferred onto the print sheet P by the transfer roller 35. The print sheet P with the toner image transferred thereon is conveyed in the conveyance path 26 to the fixing portion 19 that is disposed in the downstream side of (i.e., above) the image transfer portion 18 in the conveyance direction of the print sheet P.

The fixing portion 19 fixes the transferred toner image on the print sheet P to the print sheet P by heat. The fixing portion 19 includes a heating roller 41 and a pressure roller 42. The pressure roller 42 is biased toward the heating roller 41 by an elastic member such as a spring. As a result, the pressure roller 42 is brought into pressure contact with the heating roller 41. During the fixing operation, the heating roller 41 is heated to a high temperature by a heating device (not shown) such as a heater. When the print sheet P passes through the fixing portion 19, the toner forming the toner image is heated and fused by the heating roller 41, and the print sheet P is pressed by the pressure roller 42. This allows the toner to be fixed to the print sheet P by the fixing portion 19. That is, the toner image is fixed to the print sheet P, and an image is formed on the print sheet P. After the fixing, the print sheet P is conveyed in the conveyance path 26 from the fixing portion 19 to the paper sheet discharge port 37 by the rollers 41 and 42 of the fixing portion 19.

Figure 3:
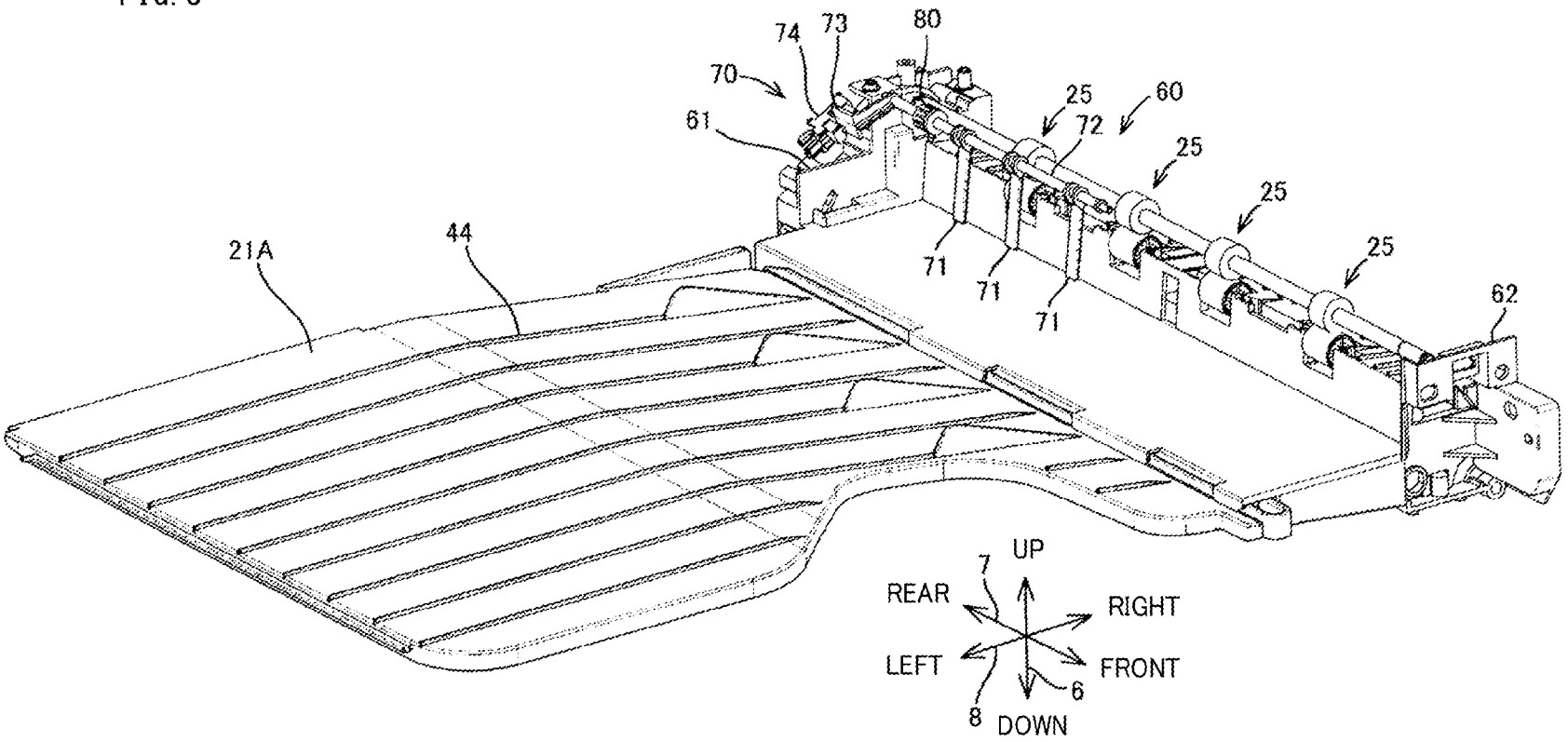
FIG. 3 is a perspective view showing a sheet discharge device in the first embodiment of the present disclosure.

The sheet discharge device 60 is provided above the fixing portion 19. The sheet discharge device 60 is provided inside the paper sheet discharge portion 30. As shown in FIG. 3, the sheet discharge device 60 includes pairs of discharge rollers 25, a sheet amount detecting mechanism 70 (an example of the detection portion of the present disclosure), and a detection position changing mechanism 80.

The pairs of discharge rollers 25 are provided near the paper sheet discharge port 37. Each pair of discharge rollers 25 is composed of a driving roller 25A and a driven roller 25B, wherein the driving roller 25A is rotationally driven by a motor, and the driven roller 25B is pressed against the driving roller 25A. A plurality of pairs of discharge rollers 25 are disposed along the front-rear direction 7 of the image forming apparatus 10. The pairs of discharge rollers 25 are configured to discharge the print sheet P from the paper sheet discharge port 37 onto the sheet discharge tray 21A. After passing through the fixing portion 19, the print sheet P is conveyed upward in the conveyance path 26. The conveyance path then changes its direction from the vertical direction to the horizontal direction, and guides the print sheet P to the paper sheet discharge port 37. When the front end of the print sheet P reaches the nip portion of the pairs of discharge rollers 25, the print sheet P is conveyed toward the sheet discharge tray 21A while being nipped by the pairs of discharge rollers 25.

Figure 4:
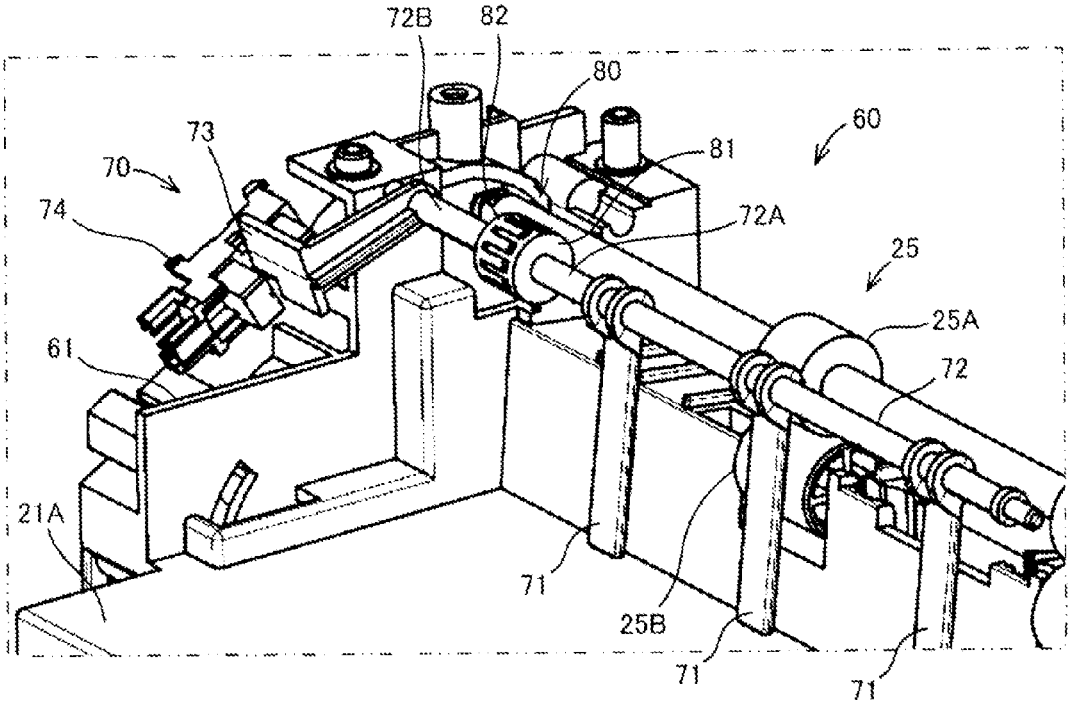
FIG. 4 is a partially enlarged view of the main portions of FIG. 3.
Figure 5:
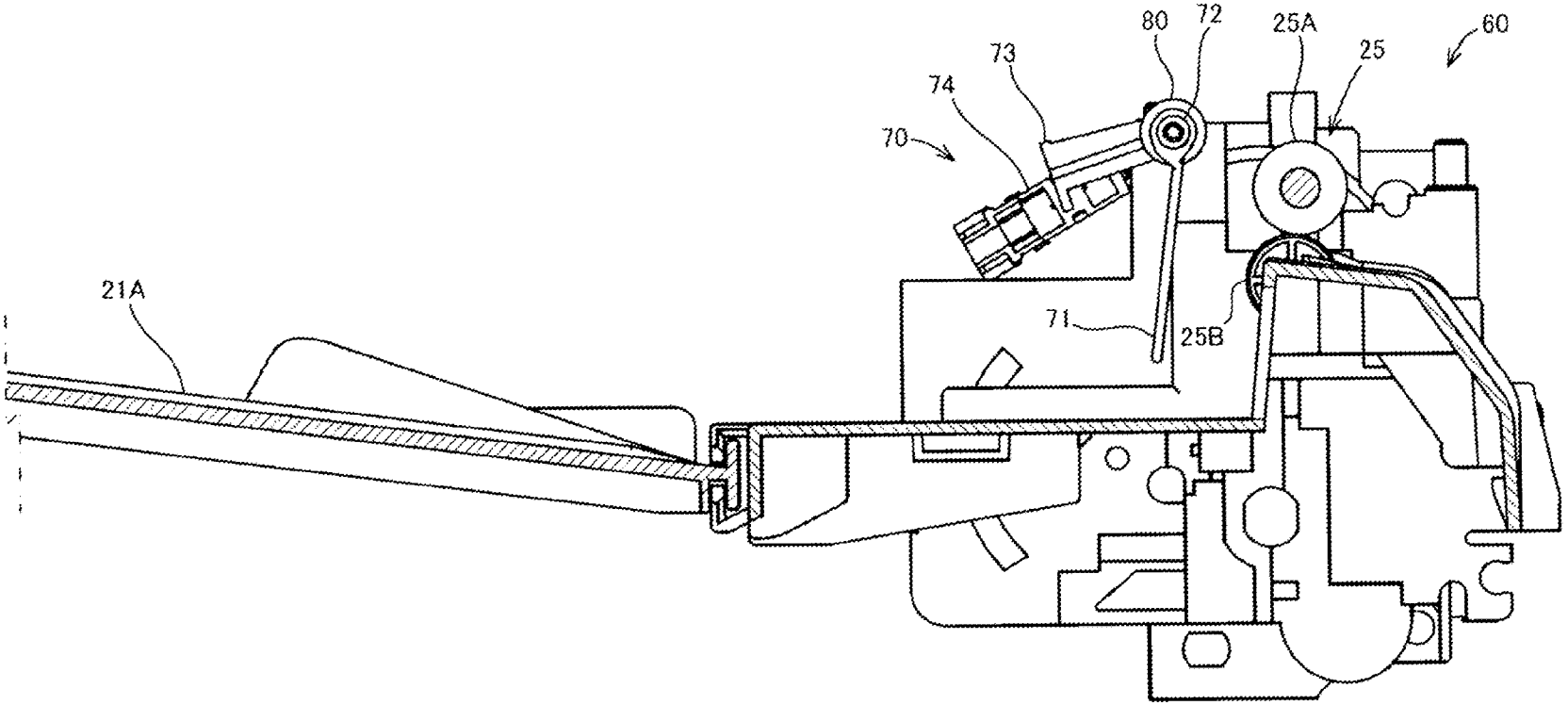
FIG. 5 is a cross section of the sheet discharge device of FIG. 3.

The sheet amount detecting mechanism 70 is provided in the downstream side of the pairs of discharge rollers 25. The sheet amount detecting mechanism 70 is configured to detect that the stack height of the sheets on the sheet discharge tray 21A has reached a predetermined detection position. As shown in FIGS. 4 and 5, the sheet amount detecting mechanism 70 includes arm-like detection members 71 (an example of the first pivoting body of the present disclosure), a pivoting shaft 72, a light blocking plate 73 (an example of the second pivoting body of the present disclosure), and an optical sensor 74 (an example of the sensor of the present disclosure).

The detection members 71 pivot to a position which corresponds to the stack height of a stack of sheets on the sheet discharge tray 21A. Specifically, the detection members 71 are attached to the pivoting shaft 72 that is provided above the paper sheet discharge port 37. The detection members 71 each extend in a radial direction of the pivoting shaft 72. The pivoting shaft 72 is pivotably supported by side frames 61 and 62 that are provided at opposite ends of the sheet discharge device 60 in the front-rear direction 7. In the present embodiment, three detection members 71 are fixed to the pivoting shaft 72. The three detection members 71 are disposed in the rear of the center of the pivoting shaft 72. A detection member 71 in the most rear side is disposed at such a position to be able to contact a discharged paper sheet of the largest size (for example, A3 size). A detection member 71 that is closest to the center of the pivoting shaft 72 is disposed at such a position to be able to contact a discharged paper sheet of the smallest size (for example, A5 size). With this configuration, when a print sheet P is discharged from the paper sheet discharge port 37, one or more detection members 71 pivot. In addition, after a print sheet P is completely discharged from the paper sheet discharge port 37 and stacked on the sheet discharge tray 21A, the upper surface of the print sheets P stacked on the sheet discharge tray 21A abuts on the detection members 71 and raises the detection members 71 upward. In this way, the detection members 71 pivot around the pivoting shaft 72 and are displaced to a position corresponding to the stack height of the stack of print sheets P.

The light blocking plate 73 is fixed to the rear end of the pivoting shaft 72. The light blocking plate 73 extends in a radial direction of the pivoting shaft 72. Upon receiving a rotational force for a rotation in the pivoting direction that is transmitted from the detection members 71 via the pivoting shaft 72, the light blocking plate 73 pivots in the same pivoting direction in conjunction with the pivoting of the detection members 71. Based on the pivoting of the detection members 71, the light blocking plate 73 reciprocates between a light-blocking position and a non-light-blocking position, wherein at the light-blocking position, the light blocking plate 73 blocks the detection light path of the optical sensor 74, and at the non-light-blocking position, the light blocking plate 73 is off the detection light path. In the present embodiment, when no print sheet P is discharged and no print sheet P is stacked on the sheet discharge tray 21A, the light blocking plate 73 is disposed at the light-blocking position, supported by a stopper member (not shown), wherein the light-blocking position is the movement lower-limit of the light blocking plate 73.

The optical sensor 74 is a sensor configured to detect that the light blocking plate 73 has reached the non-light-blocking position. The optical sensor 74 of the present embodiment is a photointerrupter that includes a light emitter such as an LED light emitting element and a light receptor such as a phototransistor. The optical sensor 74 is a transmission-type photointerrupter in which the light emitter and the light receptor are disposed to face each other across a space. The light emitter emits detection light and the light receptor receives the detection light, and when the light blocking plate 73 is disposed in the detection light path between the light emitter and the light receptor, the light path is interrupted, and the output signal of the optical sensor 74 changes from a HIGH level to a LOW level. On the other hand, when the light blocking plate 73 moves upward from the light-blocking position and is off the detection light path, the output signal of the optical sensor 74 changes from the LOW level to the HIGH level. When the output signal of the optical sensor 74 changes from the LOW level to the HIGH level, the optical sensor 74 detects that the amount of print sheets P stacked on the sheet discharge tray 21A has reached a predetermined set amount.

Meanwhile, various types of sheets are distributed in the market, and the print sheets P can be various in type. As a result, the stack form of print sheets P on the sheet discharge tray 21A varies depending on the type of the sheets. For example, depending on the material and thickness of the sheets, ends of the discharged sheets may be curled or curved. In this way, the stack form changes depending on the shape of the sheets. In addition, depending on the type of discharged sheets, the detection position with respect to the stack height of the sheets on the sheet discharge tray 21A may be desired to be higher or lower than the initial setting height. For example, in a case where sheets having low heat radiation are used and discharged after being heated during the image formation, the detection position of the stack height is desired to be lower than the initial setting height so that the heat accumulated in the stacked sheets does not adversely affect any other parts. However, conventional full stack detection mechanisms cannot change the detection position from a predetermined initial setting height to detect the stack height of the sheets on the sheet discharge tray 21A. On the other hand, according to the present embodiment, a detection position changing mechanism 80 that is described below is provided, and thus the detection position of the stack height of the sheets on the sheet discharge tray 21A can be set to an arbitrary position.

The detection position changing mechanism 80 allows for change of the detection position for the detection by the sheet amount detecting mechanism 70. The detection position changing mechanism 80 is provided on the pivoting shaft 72. In the present embodiment, the pivoting shaft 72 is divided into a pivoting shaft 72A (first pivoting shaft) and a pivoting shaft 72B (second pivoting shaft), wherein the pivoting shaft 72A pivotably supports the detection members 71, and the pivoting shaft 72B pivotably supports the light blocking plate 73. The detection position changing mechanism 80 is configured as a coupling (an example of the shaft coupling portion of the present disclosure) that allows the pivoting shaft 72A to be coupled with the pivoting shaft 72B and releases that coupling. In the present embodiment, the detection position changing mechanism 80 can be used to adjust the angle made by the detection members 71 and the light blocking plate 73.

Figure 6:
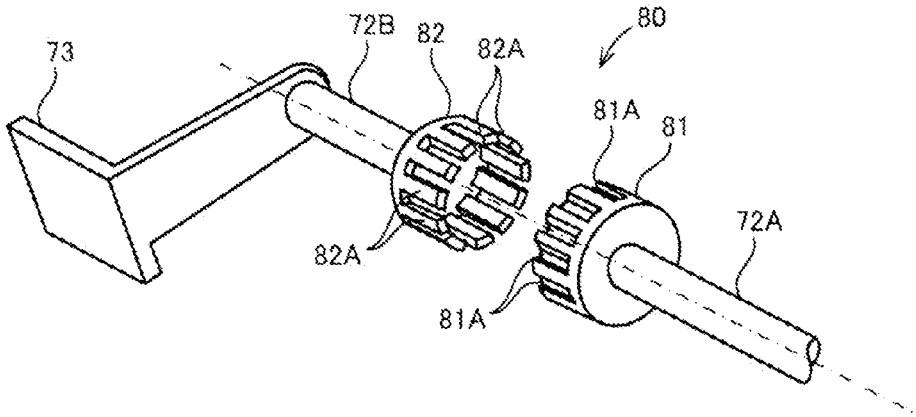
FIG. 6 is a perspective view showing a detection position changing mechanism provided in the sheet discharge device of FIG. 3.

As shown in FIG. 6, the detection position changing mechanism 80 includes shaft couplings 81 and 82, wherein the shaft coupling 81 is fixed to an end of the pivoting shaft 72A, and the shaft coupling 82 is fixed to an end of the pivoting shaft 72B. The shaft couplings 81 and 82 are configured in such a way as to be coupled with and released from each other. Specifically, the shaft coupling 81 includes a plurality of grooves 81A provided at equal intervals along the circumferential direction. Each of the grooves 81A extends, with a narrow width, long in the axis direction of the pivoting shaft 72A. The shaft coupling 82 includes a plurality of projections 82A provided at equal intervals along the circumferential direction. Each of the projections 82A extends, with a narrow width, long in the axis direction of the pivoting shaft 72B and is formed with such a size and at such a position as to be inserted into a corresponding groove among the plurality of grooves 81A. The shaft coupling 81 and the shaft coupling 82 are coupled with each other when the plurality of projections 82A are respectively inserted into the plurality of grooves 81A. With this configuration, it is possible to change the coupling position of the shaft couplings 81 and 82 in the circumferential direction to an arbitrary rotational position. That is, the angle made by the detection members 71 and the light blocking plate 73 can be adjusted arbitrarily. Specifically, the shaft coupling 81 is temporarily removed from the shaft coupling 82, and then the shaft coupling 81 is coupled with the shaft coupling 82 again after it is rotated in the circumferential direction. In this way, the coupling position of the shaft couplings 81 and 82 in the circumferential direction is changed to an arbitrary rotatational position.

Next, a description is given of the print sheet P discharging operation in the sheet discharge device 60. In the initial state where no print sheet P is discharged onto the sheet discharge tray 21A and no print sheet P is stacked on the sheet discharge tray 21A, the light blocking plate 73 is disposed at the light-blocking position, and the detection members 71 are inclined downward and stand still by its self weight (see FIG. 5). In this state, when a print sheet P is discharged from the paper sheet discharge port 37 by the pairs of discharge rollers 25, the front end of the print sheet P abuts on the detection members 71 and is discharged toward the sheet discharge space 21 while allowing the detection members 71 to pivot toward the discharge direction. When the rear end of the print sheet P passes the detection members 71 attachment position (the pivoting shaft 72A) and the print sheet P is stacked on the sheet discharge tray 21A, the detection members 71 return to the original positions, and the light blocking plate 73 returns from the non-light-blocking position to the light-blocking position.

As the above-described operation is performed each time a print sheet P is discharged, a plurality of print sheets P are stacked on the sheet discharge tray 21A. As the stack amount of print sheets P increases gradually, the detection members 71 supported by the top surface of the stacked print sheets P are gradually displaced upward. Subsequently, when the stack amount of print sheets P reaches a predetermined set amount, the detection members 71 are at such a position that allows the light blocking plate 73 to stay at the non-light-blocking position even when the rear end of the print sheet P passes the detection members 71 attachment position (the pivoting shaft 72A). At this time, the output signal of the optical sensor 74 always maintains the HIGH level. When the HIGH level is maintained for a predetermined time period, the control portion (not shown) determines that the stack amount of print sheets P on the sheet discharge tray 21A has reached the predetermined set amount.

Figure 7A:
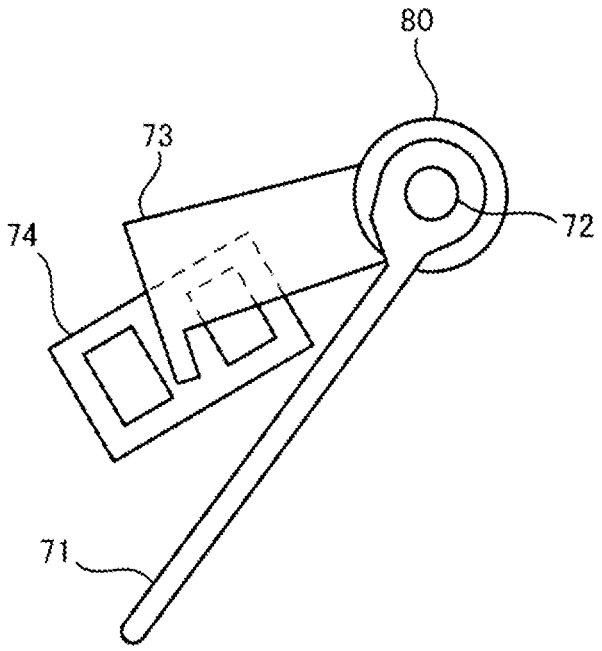
FIGS. 7A and 7B are diagrams showing the attachment states of a detection member.
Figure 7B:
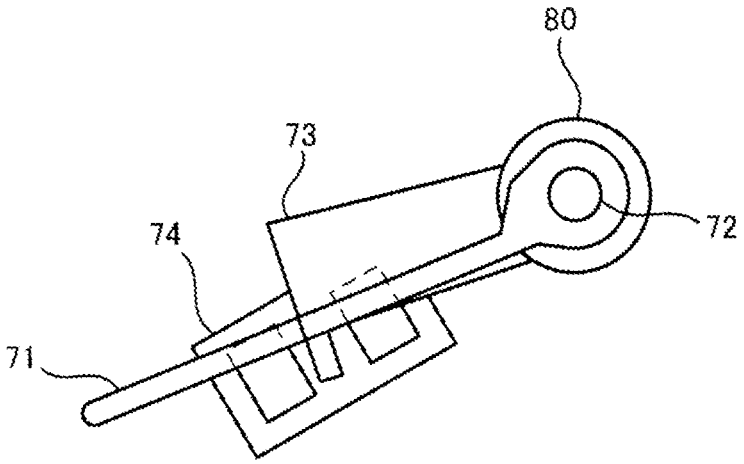

In the present embodiment, the above-described detection position changing mechanism 80 is provided in the sheet discharge device 60. This makes it possible to set the detection position for detection of the stack height of print sheets P on the sheet discharge tray 21A, to an arbitrary position. Specifically, the detection position changing mechanism 80 can be adjusted to an arbitrary position to change the inclination angle of the detection members 71 with respect to the vertical direction in the initial state. For example, as shown in FIG. 7A, the inclination angle of the detection members 71 can be made larger than the inclination angle shown in FIG. 5. In that case, the distance between the detection members 71 and the sheet discharge tray 21A in the initial state is increased. This increases the stack amount required for the detection members 71 to be displaced to the position where the light blocking plate 73 stays at the non-light-blocking position. Furthermore, as shown in FIG. 7B, the inclination angle of the detection members 71 can be made larger than the inclination angle shown in FIG. 7A. In that case, the distance between the detection members 71 and the sheet discharge tray 21A in the initial state is further increased. This further increases the stack amount required for the detection members 71 to be displaced to the position where the light blocking plate 73 stays at the non-light-blocking position.

[Second Embodiment]

Figure 8:
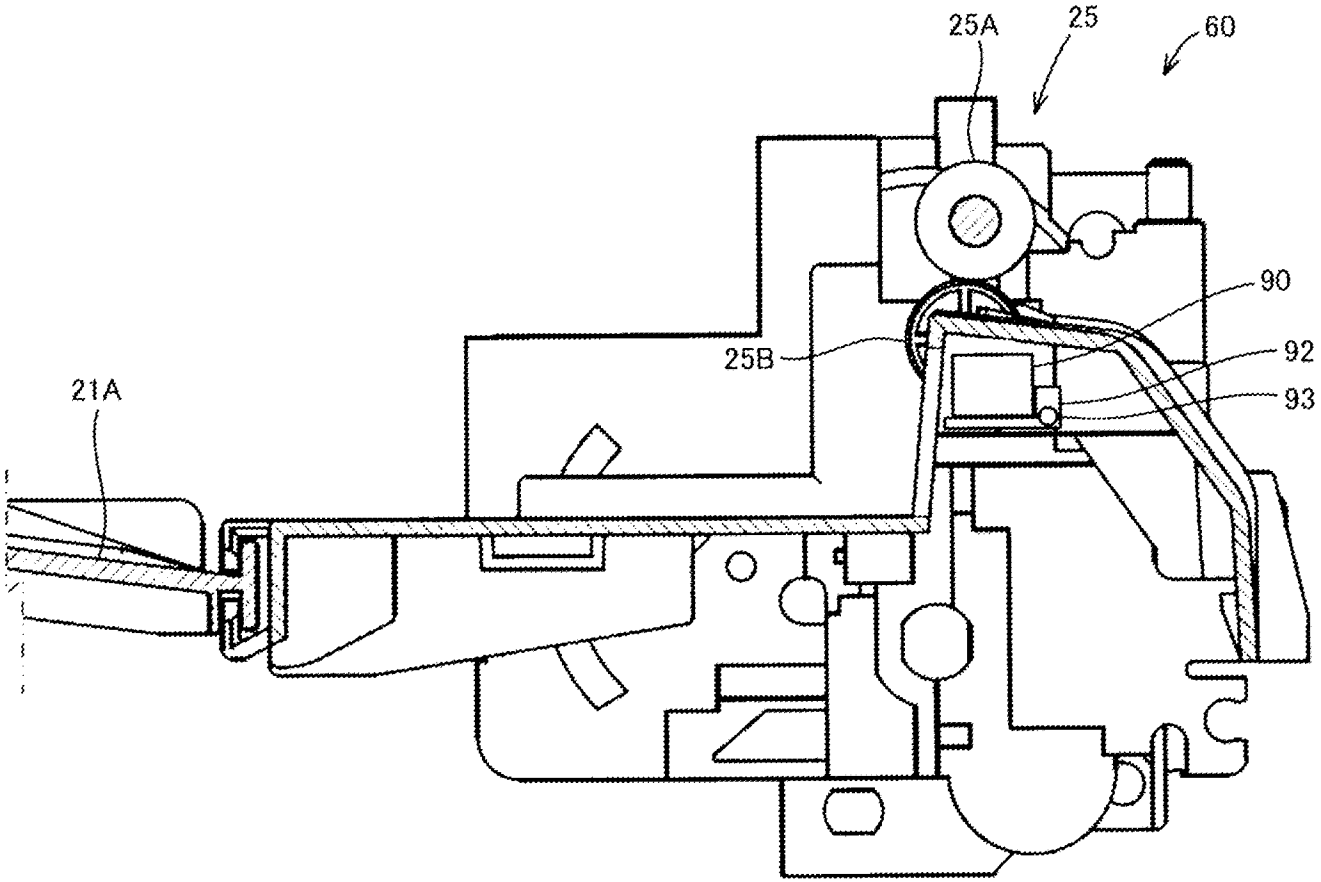
FIG. 8 is a cross section showing an image forming apparatus in the second embodiment of the present disclosure.
Figure 9:
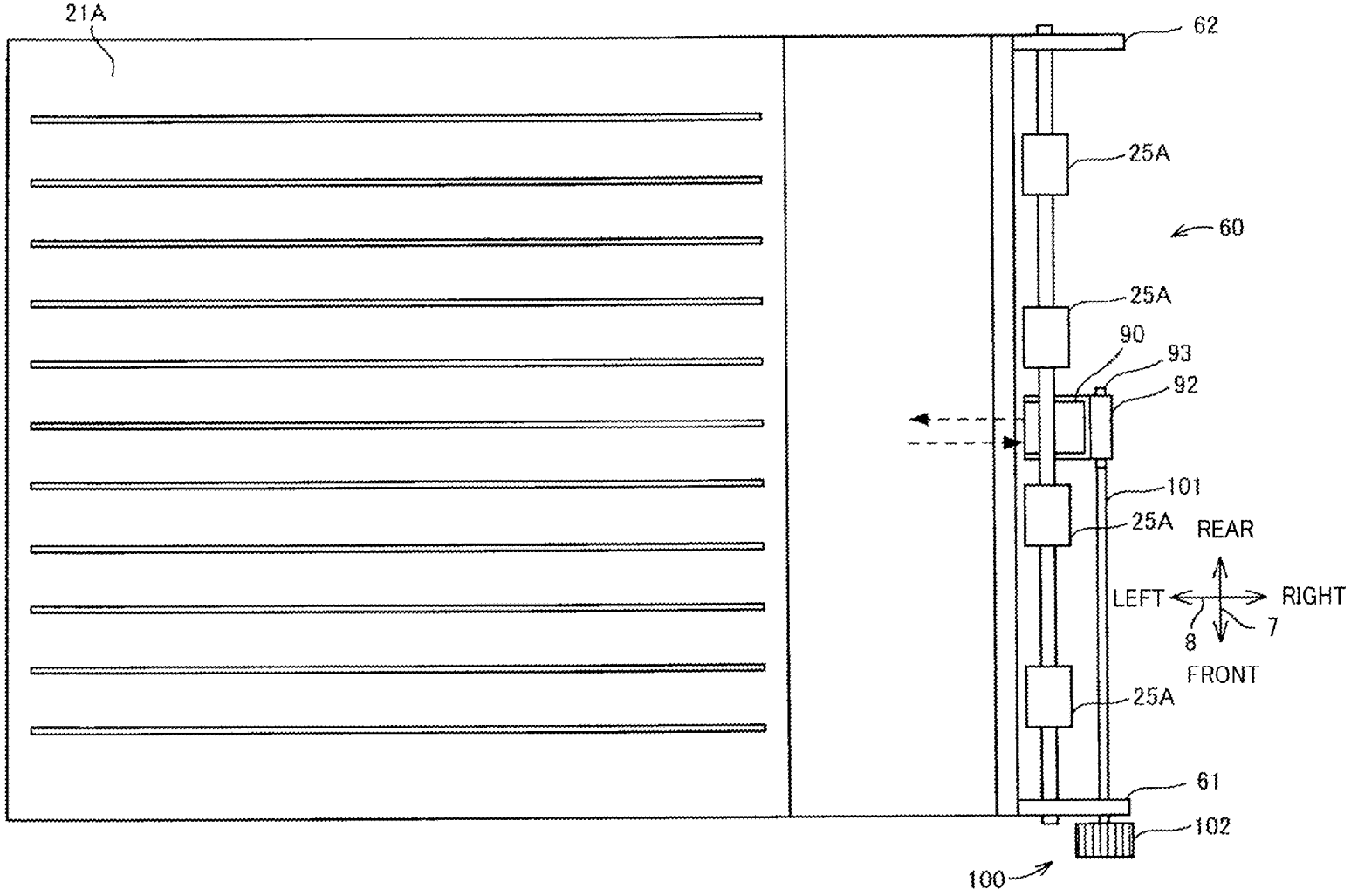
FIG. 9 is a diagram showing a detection position changing mechanism provided in the sheet discharge device of FIG. 8.

The following describes, with reference to FIGS. 8 through 10, the second embodiment of the present disclusure. In the second embodiment, a reflection-type optical sensor 90 (an example of the detection portion of the present disclosure) is used to detect the amount of sheets, in place of the sheet amount detecting mechanism 70 described in the first embodiment. In addition, a detection position changing mechanism 100 is used in place of the detection position changing mechanism 80.

As shown in FIG. 8, the optical sensor 90 is a reflection-type sensor which is configured to emit light to the side surface of a stack of sheets on the sheet discharge tray 21A and receive reflected light therefrom. Specifically, the optical sensor 90 is a reflection-type photointerrupter. The optical sensor 90 is attached to the internal frame of the paper sheet discharge portion 30 via a support bracket 92, below the paper sheet discharge port 37 and above the upper surface of the sheet discharge tray 21A. When the amount of print sheets P stacked on the sheet discharge tray 21A is smaller than the set amount, the optical sensor 90 does not receive the reflected light and outputs a signal of a LOW level. On the other hand, when the amount of print sheets P stacked on the sheet discharge tray 21A is equal to or larger than the set amount, the optical sensor 90 receives the reflected light and outputs a signal of a HIGH level. When the output signal of the optical sensor 90 changes from the LOW level to the HIGH level, the control portion (not shown) determines that the stack amount of print sheets P on the sheet discharge tray 21A has reached the predetermined set amount.

The detection position changing mechanism 100 changes the position of the light spot on the side surface of the stack of print sheets P, the light spot being made by the light emitted from the optical sensor 90. Specifically, the detection position changing mechanism 100 allows the optical sensor 90 to pivot to change the light emission angle such that the light spot shifts in the height direction of the stack of print sheets P (a direction perpendicular to the upper surface of the sheet discharge tray 21A). As shown in FIG. 9, the detection position changing mechanism 100 includes a support bracket 92 (an example of the sensor supporting portion of the present disclosure), an adjustment shaft 101, and an operation dial 102. The adjustment shaft 101 and the operation dial 102 are an example of the operation portion of the present disclosure. The optical sensor 90 is fixed to the support bracket 92. The support bracket 92 is supported by the internal frame of the paper sheet discharge portion 30 in such a way as to be able to pivot around the pivoting shaft 93 that extends in the front-rear direction 7. This allows the support bracket 92 to support the optical sensor 90 in such a way as to be able to pivot in a rotational direction (predetermined direction) around the pivoting shaft 93. The adjustment shaft 101 is provided for the adjustment of the position of the optical sensor 90, and is coupled with the support bracket 92 of the optical sensor 90. Specifically, the adjustment shaft 101 is coupled with the pivoting shaft 93 of the support bracket 92 and extends frontward from the coupling portion. The operation dial 102 is coupled with the front end of the adjustment shaft 101. A scale indicator (not shown) such as a rotation angle scale is provided on the operation dial 102, wherein the scale indicator is formed in such a way as to indicate the pivoting position of the optical sensor 90. The scale indicator is provided on a side surface of the operation dial 102.

Figure 10A:
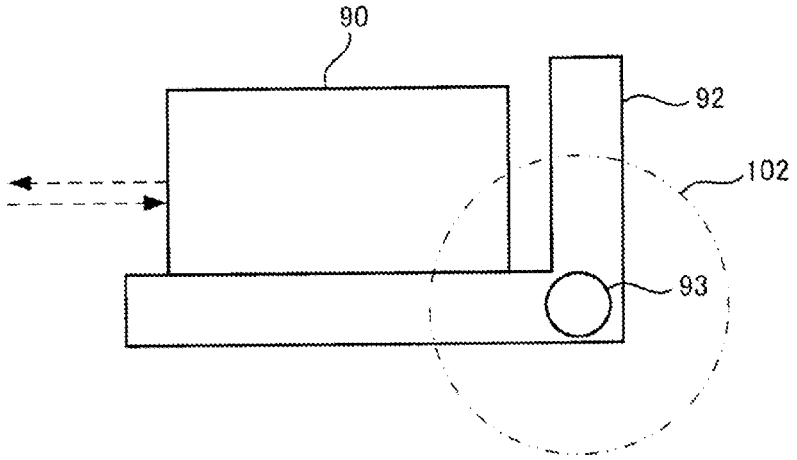
FIGS. 10A through 10C are diagrams showing a detection position changing mechanism provided in the sheet discharge device of FIG. 8.
Figure 10B:
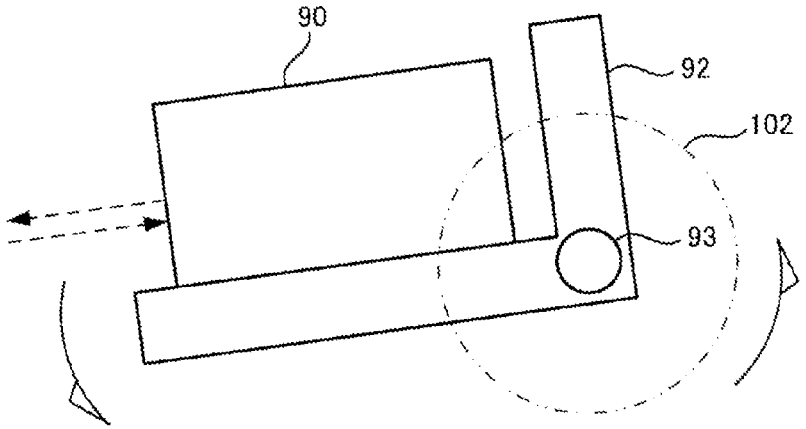
Figure 10C:
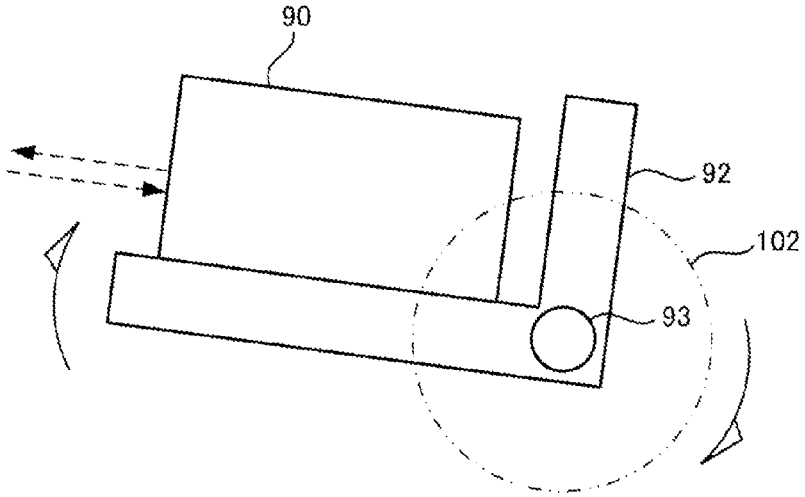

FIG. 10A shows the reference attitude of the optical sensor 90. When the operation dial 102 is rotated counterclockwise from the reference attitude, the optical sensor 90 pivots around the pivoting shaft 93 and the light emission direction is shifted downward (see FIG. 10B). With this operation, the light spot on the side surface of the stack of print sheets P is shifted downward. By shifting the light spot downward, it is possible to reduce the stack amount (set amount) of print sheets P that is required to receive the reflected light. In addition, when the operation dial 102 is rotated clockwise from the reference attitude, the optical sensor 90 also pivots around the pivoting shaft 93 and the light emission direction is shifted upward (see FIG. 10C). With this operation, the light spot on the side surface of the stack of print sheets P is shifted upward. By shifting the light spot upward, it is possible to increase the stack amount (set amount) of print sheets P that is required to receive the reflected light. Furthermore, since the scale indicator is provided on the operation dial 102, the user can recognize the rotation amount of the optical sensor 90 when he/she rotationally operates the operation dial 102. This enables the user to recognize the stack amount of print sheets P before and after the operation.

[Third Embodiment]

Figure 11A:
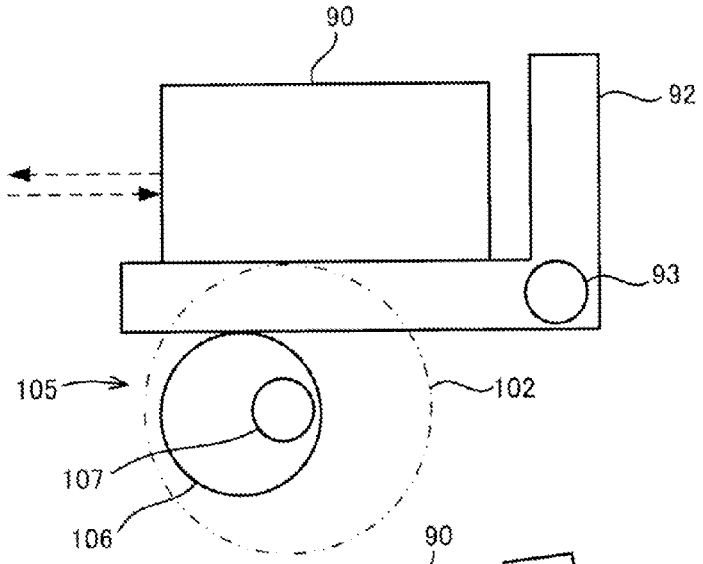
FIGS. 11A through 11C are diagrams showing a detection position changing mechanism provided in the sheet discharge device in the third embodiment of the present disclosure.
Figure 11B:
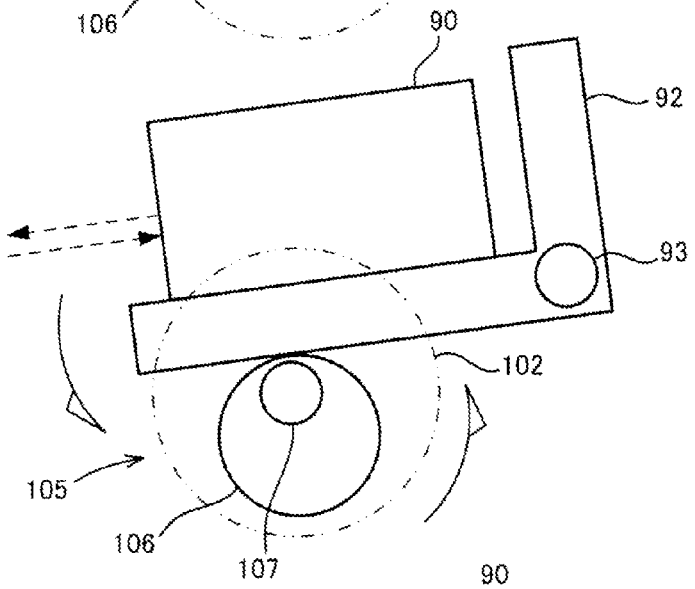
Figure 11C:
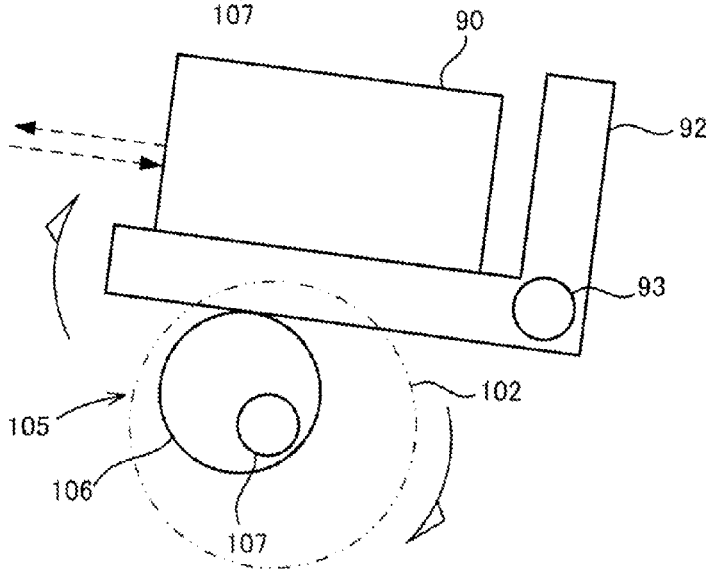

FIGS. 11A through 11C shows the third embodiment of the present disclosure in which a cam driving mechanism 105 is applied to the mechanism for allowing the support bracket 92 to pivot in the detection position changing mechanism 100 of the second embodiment. As shown in FIGS. 11A through 11C, in the cam driving mechanism 105 adopted in the third embodiment, the adjustment shaft 101 is not coupled with the pivoting shaft 93, but is coupled with a pivoting shaft 107 of an eccentric cam 106 that is abutting on the bottom surface of the support bracket 92. Even with this configuration, it is possible, with operation of the operation dial 102, to shift the light spot made by the light emitted from the optical sensor 90, on the side surface of the stack of print sheets P.

[Fourth Embodiment]

Figure 12A:
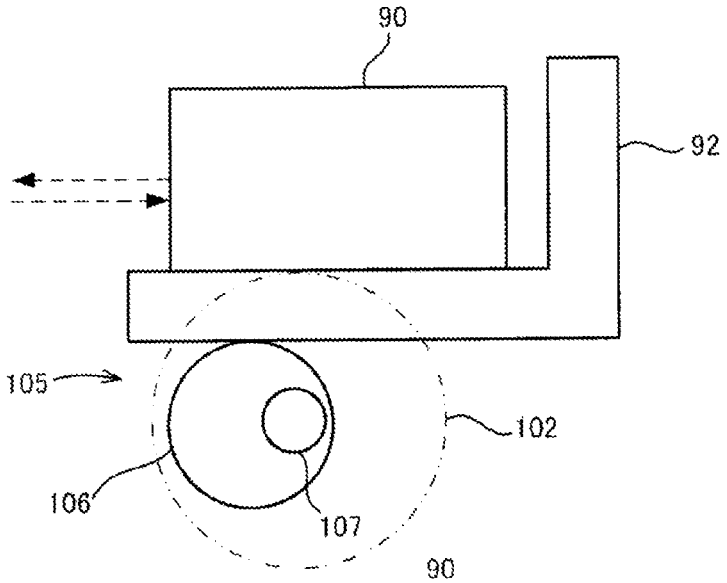
FIGS. 12A through 12C are diagrams showing a detection position changing mechanism provided in the sheet discharge device in the fourth embodiment of the present disclosure.
Figure 12B:
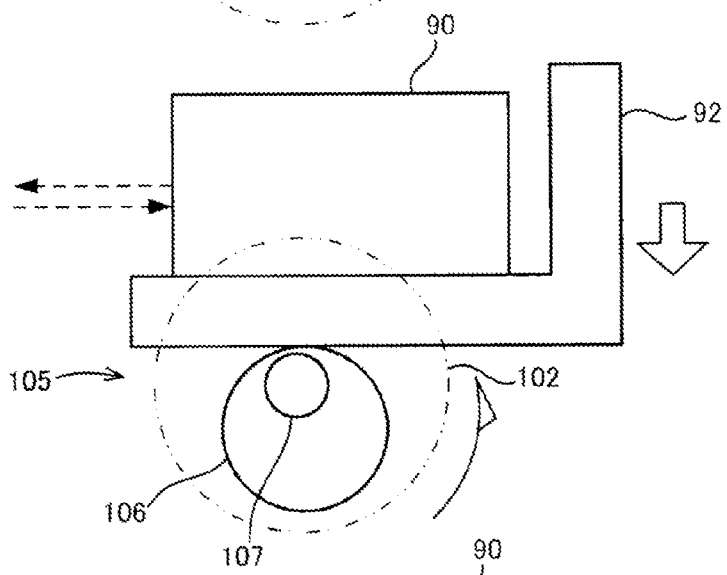
Figure 12C:
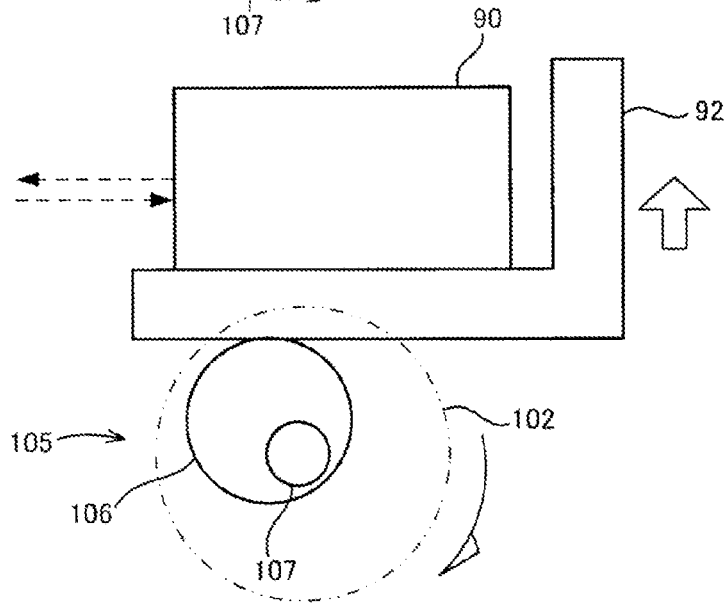

FIGS. 12A through 12C shows the fourth embodiment of the present disclosure to which is applied, in place of the mechanism in the detection position changing mechanism 100 of the third embodiment for allowing the support bracket 92 to pivot, a mechanism that uses the cam driving mechanism 105 to move the support bracket 92 in the height direction of the stack of print sheets P. As shown in FIGS. 12A through 12C, according to the configuration adopted in the fourth embodiment, the adjustment shaft 101 is not coupled with the pivoting shaft 93, but is coupled with the pivoting shaft 107 of the eccentric cam 106 that is abutting on the bottom surface of the support bracket 92. In addition, the optical sensor 90 is fixed to the support bracket 92, and the support bracket 92 is supported by the internal frame of the paper sheet discharge portion 30 in such a way as to be able to move in the height direction of the stack of print sheets P. With the detection position changing mechanism 100 configured as such, it is possible, with operation of the operation dial 102, to move the optical sensor 90 in the height direction of the stack of sheets and shift the light emission position in the height direction of the stack of sheets. That is, it is possible to shift, in the height direction of the stack of sheets, the position of the light spot made by the light emitted from the optical sensor 90, on the side surface of the stack of print sheets P.

The above-described embodiments describe the sheet discharge device 60 in which the print sheets P are discharged from the image forming portion 14. However, the present disclosure is not limited to this configuration. For example, the present disclosure is applicable to a mechanism of the ADF 13 in which a document sheet is discharged to the sheet discharge portion 49 by the conveying rollers 47.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet discharge device comprising:

a discharge roller configured to discharge a sheet from a sheet discharge port toward a sheet discharge tray;

a detection portion configured to detect that a stack height of sheets on the sheet discharge tray has reached a predetermined detection position; and a detection position changing mechanism configured to change the detection position for the detection portion, wherein the detection portion includes:

a first pivoting shaft that is parallel with an axis direction of the discharge roller;

a first pivoting body that is attached to the first pivoting shaft and extends in a radial direction of the first pivoting shaft;

a second pivoting shaft that is configured to be coupled with the first pivoting shaft;

a second pivoting body that is attached to the second pivoting shaft and extends in a radial direction of the second pivoting shaft; and a sensor configured to detect that the second pivoting body has reached the detection position, the first pivoting body contacts an upper surface of the sheets stacked on the sheet discharge tray and is pivotable to a position that corresponds to the stack height of the sheets on the sheet discharge tray, the second pivoting body is pivotable in conjunction with a pivoting operation of the first pivoting body, and the detection position changing mechanism is a shaft coupling portion configured to couple the first pivoting shaft with the second pivoting shaft at an arbitrary position among a plurality of rotational positions that are defined in a circumferential direction.

2. The sheet discharge device according to claim 1, wherein in the shaft coupling portion, the first pivoting shaft of the first pivoting body and the second pivoting shaft of the second pivoting body are configured to be coupled with each other and released from each other in such a way that an angle in a pivoting direction made by the first pivoting body and the second pivoting body is adjustable.

3. An image forming apparatus comprising the sheet discharge device according to claim 1.

* * * * *